US006699137B2

(12) United States Patent
Szymanski

(10) Patent No.: US 6,699,137 B2
(45) Date of Patent: Mar. 2, 2004

(54) GOLF COURSE FOR PLAYING NIGHT GOLF

(76) Inventor: Matthew E. Szymanski, 1652 Tattenham Way, Orlando, FL (US) 32837

( * ) Notice: Subject to any disclaimer, the term of this patent is extended or adjusted under 35 U.S.C. 154(b) by 0 days.

(21) Appl. No.: 10/176,538

(22) Filed: Jun. 21, 2002

(65) Prior Publication Data

US 2003/0004006 A1 Jan. 2, 2003

Related U.S. Application Data

(60) Provisional application No. 60/301,207, filed on Jun. 28, 2001.

(51) Int. Cl.[7] ..... A63B 57/00; A63B 69/36; F21V 8/00

(52) U.S. Cl. ..... 473/169; 362/559; 362/581

(58) Field of Search ..... 473/131, 100, 473/157–176, 180, 181, 185, 195–197; 362/559, 581

(56) References Cited

U.S. PATENT DOCUMENTS 3,104,879 A * 9/1963 Jetton ..... 473/153
3,918,719 A * 11/1975 Welch ..... 473/409
4,489,669 A * 12/1984 Carman ..... 116/202
4,927,015 A * 5/1990 Jones ..... 206/315.9
5,076,586 A * 12/1991 Taniguchi et al. ..... 473/169
5,163,684 A * 11/1992 Seidler ..... 473/196
5,265,875 A * 11/1993 Fitzgerald ..... 473/169
5,445,373 A 8/1995 Franks
5,580,319 A * 12/1996 Hamilton ..... 473/150
6,030,108 A * 2/2000 Ishiharada et al. ..... 362/562
6,099,139 A * 8/2000 Lapensee ..... 362/153.1
6,116,751 A * 9/2000 Remp ..... 362/153
2002/0098899 A1 * 7/2002 Newcomb et al. ..... 473/157
2002/0159275 A1 * 10/2002 Nicholls et al. ..... 362/559

* cited by examiner

*Primary Examiner*—Mark S. Graham
(74) *Attorney, Agent, or Firm*—William M. Hobby, III

(57) ABSTRACT

A method of adapting a golf course for playing golf at night using a glow-in-the-dark golf ball includes selecting an elongated flexible light source and placing it around the perimeter of a golf course putting green, fairway, bunkers, and other hazards and anchoring the placed elongated flexible light source to the earth with anchoring stakes. The golf hole may have the rim illuminated and may have a night visible flag. The selected and placed elongated flexible light source is partially buried to provide a smooth surface thereover. The elongated flexible light source, such as a plurality of light emitting diodes (LEDS), may be placed in a flexible transparent polymer tube or channel and may be an electro-illuminescent wire or incandescent bulbs or LED spaced within a polymer tube or an elongated fiberoptic lighted from one end.

15 Claims, 3 Drawing Sheets

GOLF COURSE FOR PLAYING NIGHT GOLF

This application claims the benefit of Provisional application No. 60/301,207 filed Jun. 28, 2001.

BACKGROUND OF THE INVENTION

This invention relates generally to a method of adapting a golf course for playing night golf and more particularly to a method of adding an in-ground perimeter lighting system to a golf course.

A significant amount of time is required to complete an entire eighteen hole round of golf or even to complete a partial round of nine holes. An expert golfer may take up to three hours to complete an entire golf round where a novice golfer may require even more time. If a golf course is being heavily used by many golfers at the same time, the amount of time required to complete a golf round is further increased.

Because of the extensive time requirements and because golf can only be played outdoors, the number of hours available for playing golf within any 24 hour period is very limited. During the winter months, when it becomes dark relatively early, it would be impossible for a golfer, after a typical eight hour work day, to complete a round of golf before it gets dark. In some golf course locations, during the summer months it is too hot to comfortably play golf during the middle of the day and as the temperature falls later into the evening, it is too dark to play golf. This limited time window for playing golf limits the number of total rounds that can be played on any one golf course over a year and prevents many people with restrictive schedules from golfing as often as they would like.

To increase the number of hours in a day in which golf can be played, lights have been installed on some golf courses. However, a golf course covers a significant amount of land. For example, a typical golf course can encompass over 100 acres. This amount of area requires a large number of lights to sufficiently light the entire golf course. In addition, because the golf ball is relatively small and is hit a relatively long distance (i.e. up to 300 yards), there must be even more lighting than might normally be imagined.

For example, conventional golf course lighting must illuminate the golf ball while lying on the ground and while traveling in the air. The ground area must be sufficiently illuminated so that a golfer can locate the relatively small golf ball from a sufficient distance away. The sky above the golf course must also be sufficiently illuminated so that after the golf ball is hit with a golf club, the golfer can see the trajectory of the ball while it is traveling through the air. Being able to see the ball trajectory is important for identifying the approximate location where the golf ball lands after being hit with the golf club. Being able to see the golf ball trajectory is also necessary so that a golfer can fully appreciate the quality of his shot, thereby increasing the golfer's enjoyment of the golf round.

Previous attempts to light golf courses involve attaching large, high voltage, alternating current (AC) driven lamps at various locations around the golf course. The lights are mounted high above the ground to provide the most effective location for lighting the most area on each golf hole. The lights are either attached to poles mounted into the ground or attached to trees that presently reside around the golf course. Underground cable is then run from a public power supply to each light on the golf course.

A conventional lighting system can be expensive to install since cable must be routed through the ground to every remote location on the golf course, some locations being one or two miles from the closest power source. The lights are also expensive, since they must produce a maximum number of foot candles to illuminate the largest amount of space. Lamps of this size use a large amount of wattage and, therefore, are also expensive to operate. In addition, the lamps must be periodically replaced which increases golf course maintenance costs. Since the lamps must be positioned high above the ground, it is also time consuming and dangerous for maintenance personnel to travel to each light location, position a ladder underneath the light, and climb the ladder to the light fixture to replace the lamp.

If the lamps are attached to specially constructed support poles, the poles create an additional obstruction that would not otherwise exist on a non-lighted golf course. These poles detract from the quality of the golf course during daytime playing. For lamps that are attached to trees surrounding the golf course, a power cable must be run from the ground to the lighting fixture. The cable is supported with clamps mounted in the tree. These clamps, along with the lighting fixture mountings, can damage or kill the tree. The power cables and lighting fixtures also detract from the aesthetic beauty of the golf course during the day, which is a significant factor to a golfer's overall enjoyment of the golf course. Because of the physical size of each high wattage light and the time required to mount the lights above the ground on special support poles or trees, it would not be practical for the lighting fixtures to be removed every day. Therefore, the lamps and lighting fixtures are exposed to year-round weather conditions that decrease the operating life of the lighting system.

Some attempts have been made to provide portable golf course lighting. However, the portable light source is insufficient for effectively playing golf at night. U.S. Pat. No. 3,918,719 to Welch shows a transportable light that is attached to a golf cart to illuminate spots on a golf course at night. This light, however, does not effectively identify the overall layout of a golf hole. Thus, the golfer often will not know where to direct his golf shot. In addition, the light source is attached to a golf cart, which cannot illuminate a golf ball outside the limited range of the golf cart. This would make it difficult to track the trajectory of the golf ball after being hit with a golf club and to find the golf ball after it returns to the ground.

In U.S. Pat. No. 5,445,373, a portable lighting system is utilized with glow-in-the-dark golf balls to play night golf. The lighting system uses portable rechargeable lights hauled in a trailer to light areas of the golf course and light sticks are used to illuminate around the golfer.

Previous methods for playing golf at night include using glow-in-the-dark golf balls. Illuminated golf balls are known in the art and are described in U.S. Pat. No. 3,351,347 to Smith et al., U.S. Pat. No. 4,798,386 to Berard, and U.S. Pat. No. 4,991,852 to Melesio. While an illuminated golf ball provides sufficient contrast for easy identification at night, the golfer still does not know where to direct his golf shot and cannot identify the specific hazards on each golf hole. The golfer is not able to see a sand trap, water hazard, or trees that determine where the golf shot should be directed.

According, a need exists for a golf course that allows a golfer to play golf at night and that allows the golfer to discern the general layout and hazards of each golf hole.

SUMMARY OF THE INVENTION

A method of adapting a golf course for playing golf at night using a glow-in-the-dark golf ball includes selecting an elongated flexible light source and placing it around the perimeter of a golf course putting green, fairway, bunkers, and other hazards and anchoring the placed elongated flexible light source to the earth with anchoring stakes. The golf hole may have the rim illuminated and may have a night visible flag. The selected and placed elongated flexible light source is partially buried to provide a smooth surface thereover. The elongated flexible light source, such as a plurality of light emitting diodes (LEDS), housed in their own protective polymer jacket may be placed in a flexible transparent polymer channel or tube. An electro-illuminescent wire or incandescent bulbs spaced within a polymer tube or an elongated optical fiber may also be used.

BRIEF DESCRIPTION OF THE DRAWINGS

Other objects, features, and advantages of the present invention will be apparent from the written description and the drawings in which.

DETAILED DESCRIPTION OF THE PREFERRED EMBODIMENT

Figure 1:
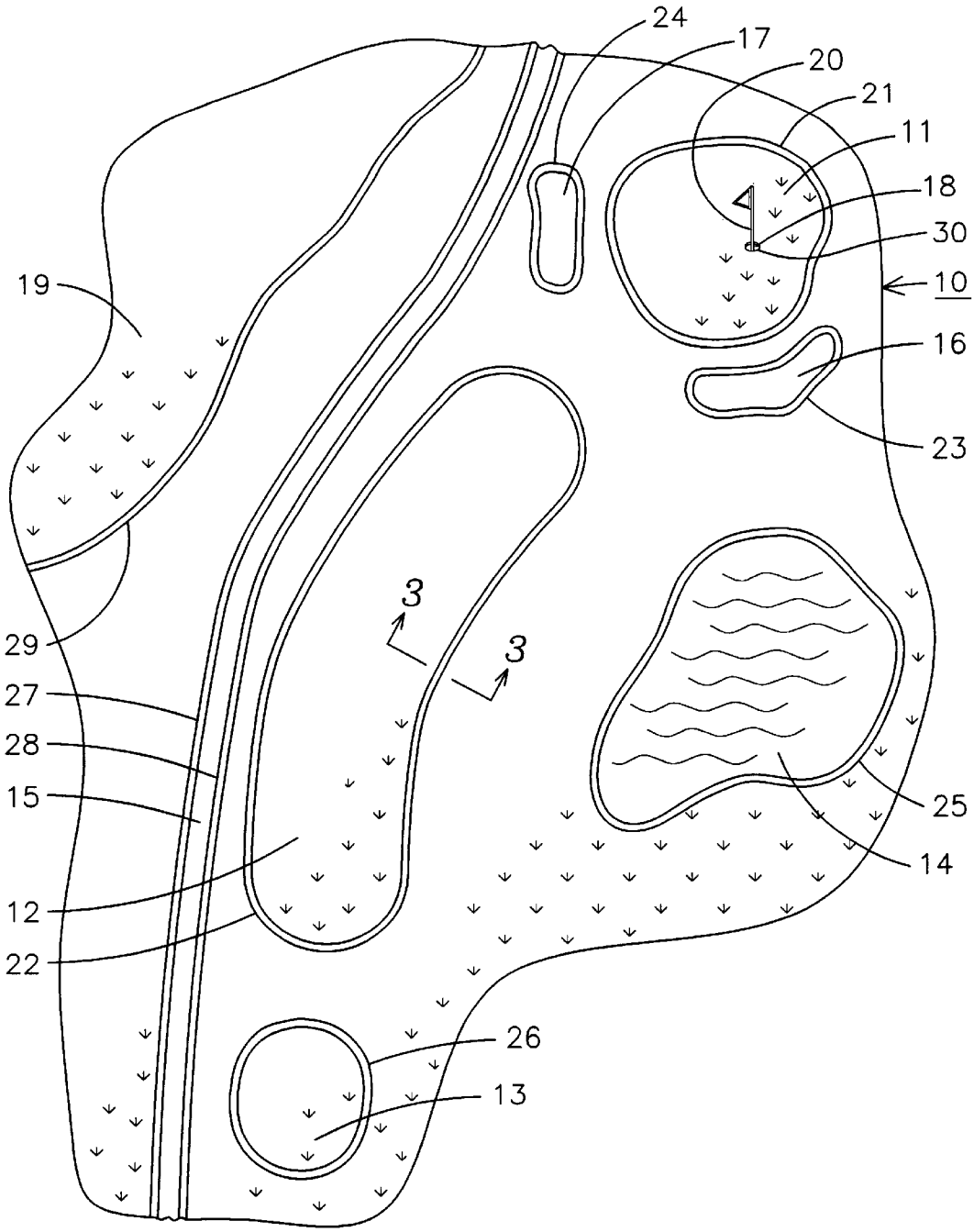
FIG. 1 is a perspective of one hole of a golf course having the perimeter lighting of the present invention.

Referring to the drawings and especially to FIG. 1, a golf course 10 has a putting green 11 and a fairway 12 and a teeing area 13 along with a water hazard 14. The golf course 10 is also shown having a marked walkway or cart path 15 and a pair of sand trap hazards 16 and 17 and a waste bunker 19. The putting green 11 can be seen having a hole 18 with a flag 20 mounted in the hole 18. The green 11 has an elongated flexible light source 21 attached to the earth around the perimeter thereof so that at night, an outline of the green 11 can be seen from a distance. The illuminated flag 31 is mounted to an illuminated flagpole 20 that can be seen from a distance at night. In addition, the fairway 12 has an elongated flexible light source 22 mounted along the periphery thereof and each of the sand trap hazards 16, 17 has a perimeter elongated flexible light 23 in channel 38. Similarly, a water hazard 14 has a surrounding elongated flexible light source 25 around the perimeters thereof. The tee ground 13 also has an elongated flexible light source 26 mounted around the periphery thereof and the walking or cart path 15 may have elongated light sources 27 and 28 marking the outline of the cart path. The waste bunker 19 has a light source 29 therearound. The light sources 21, 22, 23, 24, 25 and 29 can each be made of different colors as desired to distinguish between, for instance, the golf green and golf course hazards.

As can be seen at this point, the golf course will at night form a visible outline of the teeing area, fairway, putting green, sand traps and water hazards. A golfer can drive a glow-in-the-dark golf ball from the teeing area 13 towards the putting green 11 across the fairway 12 and can readily see where the glow-in-the dark ball lands for making the next shot always towards the putting green 11 and flag 20. The hole 18 has a flexible light 30 along its interior rim for directing the golf ball towards the hole. The elongated perimeter light source is mounted in the earth in a trench within an elongated transparent polymer channel. This allows the light source to be visible above ground allowing a golf ball to roll thereover without impeding the roll of the golf ball. The elongated flexible light source may be an LED rope light or an electro-illuminescent wire or may be an optical fiber or may be miniature incandescent bulbs placed inside an elongated tube. A flat light source may also be used. In any event, it is normally mounted within a flexible elongated polymer tube or channel to protect the light source from the weather and elements, including rain and sprinkler water and damage from golfers walking or carts riding thereover. It should be clear that a glow-in-the-dark material without the need of an external power source may also be used without departing from the spirit and scope of the invention.

Figure 2:
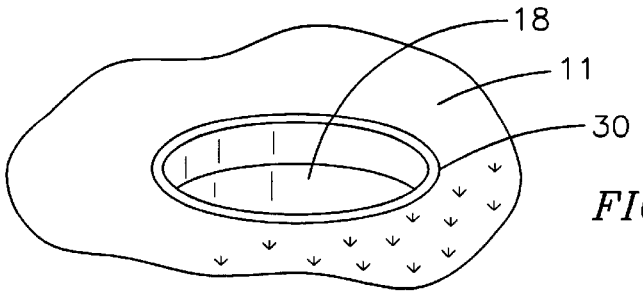
FIG. 2 is a partial perspective of a golf course hole having rim lighting.

In FIG. 2, a portion of the putting green 11 is illustrated having the hole 18 and the rim light source 30 mounted around the opening 18 so that the golfer can see the opening for putting a golf-in-the-dark ball.

Figure 4:
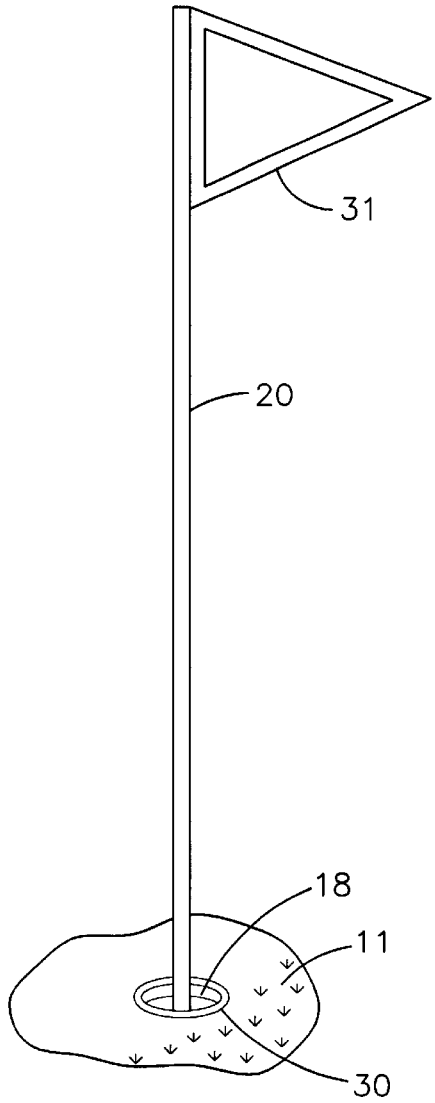
FIG. 4 is a partial perspective of a golf hole having an illuminated flag pole therein.

FIG. 4 shows the golf hole 18 with the wrap around light source 30 mounted in the golf course putting green 11 and having the illuminated flag pole 20 mounted therein with a flag 31 mounted thereon which can also be an illuminated or glow-in-the-dark type flag 31 if desired.

Figure 3:
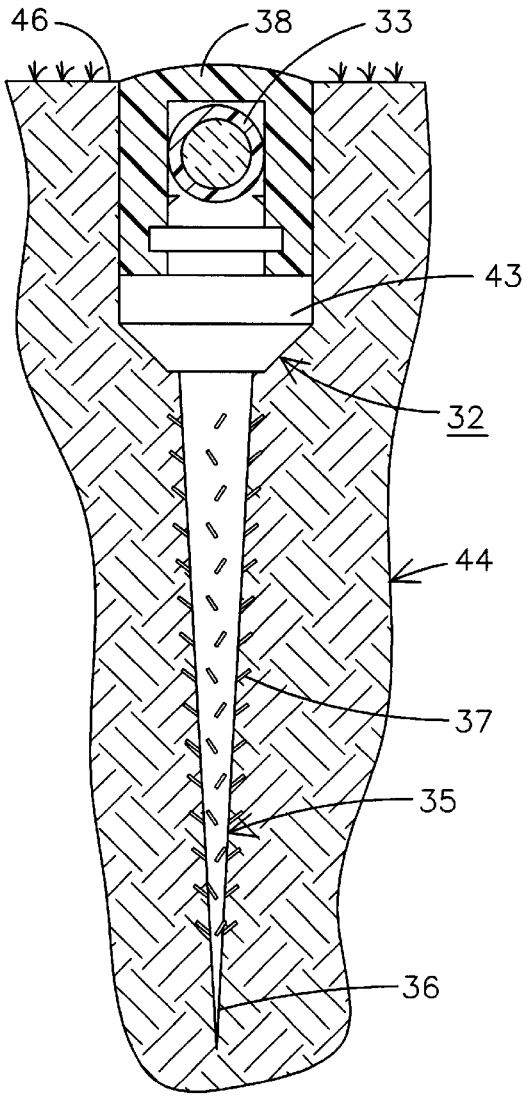
FIG. 3 is a sectional view taken through the lighting supported in the earth with a flexible elongated lighting source held in a support channel mounted in the earth.
Figure 5:
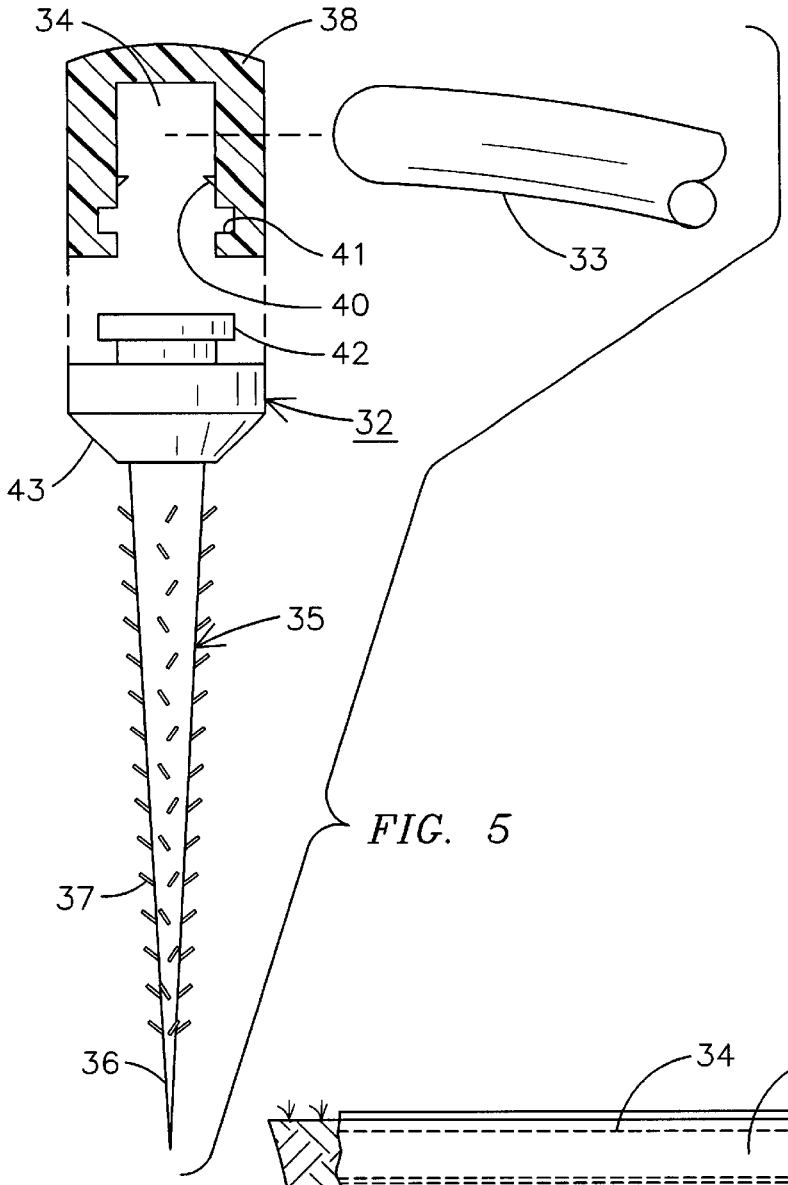
FIG. 5 is an exploded view of a light source tube being inserted into the clear channel being attached to the earth anchor.
Figure 6:
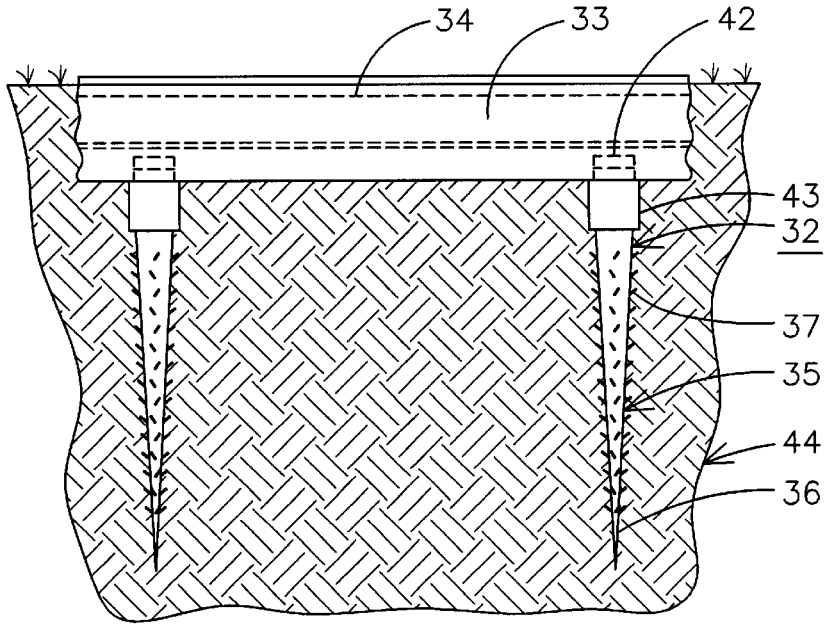
FIG. 6 is a sectional view of a pair of earth anchors having a lighted source connected therein and supported in a trench in the earth for forming the perimeter lighting.

Referring to FIGS. 3, 5 and 6, the earth anchor 32 for anchoring the flexible transparent channel 38 to the earth and having the elongated light source 33 being inserted into a supporting channel bore 34 in FIG. 5. The channel 38 and light source 33 are mounted on part of a stake portion 35 having a generally pointed end 36 and a plurality of earth holding barbs 37. Light tube 33, which may also be a tube having a square or rectangular cross section, is inserted into the opening area 34 of the channel 38 which may have barbs 40 thereon and has grooves 41 for attaching the channel 38 to the flange 42 extending from the top of the base 43 as illustrated in FIGS. 3 and 6. The earth anchor 32 is anchored in the earth 44 by attaching the flexible transparent polymer channel 38 with the bracket portion of the channel attached to the stake base 43. The stake portion 35 has been driven into the earth 44 with the plurality of barbs 37 supporting the earth anchor 35 in position and holding the light tube 33 in position in channel 38 in the earth surface 46.

In the case of FIGS. 5 and 6, a plurality of earth anchors 32 are mounted in the earth 44 supporting a transparent flexible polymer channel 38 having an elongated light source 33 mounted therein supported in the open portion 34 of transparent channel 38 attached to the base 43 of the earth anchor 32. The stake portion 35 is driven into the earth 44.

As can be seen, the night golf system can be readily applied to a golf course, as shown in FIG. 1, mounted with a flexible elongated light source system along the perimeter of the golf green 11, fairway 12, teeing area 13, water hazard 14, and sand trap hazards 16, 17 by forming a small trench for placing the elongated light source and channel and mounting the channel to the stakes 32 which are then driven into the earth with the channel 38 covering the light source 33 aligned with the earth top 46. The golf hole 18 can then be lined with a light source 30 and a golf pole may be illuminated and inserted in the hole. A conventional glow-in-the-dark golf ball available commercially can be utilized for playing golf in the dark by driving the golf ball between the well outlined golf course. The light source 33 can be driven by any power source, such as rechargeable batteries but also from an electrical source wired through the golf course, such as an electric generator or other source, and connected underground to the light source. The light source, such as a light emitting diode rope, requires only a small amount of power for producing the lighted perimeters.

It should be clear at this time that a lighted golf course and a method of adapting a golf course for playing golf at night has been provided using a glow-in-the-dark golf ball. The method includes selecting the elongated flexible light source which may be encased or covered with an elongated transparent polymer channel and placing the elongated flexible light source around the perimeter of a golf course putting green, fairway, teeing area, bunker and hazard. The light source in the transparent channel is then anchored to the earth to provide a visible outline marking the golf course putting green, golf hole, and golf hole flag with night visible markings so that a game of golf can be played during the nighttime. The light sources may be of different colors for hazards, fairways and golf greens, as desired, to allow a golfer to readily distinguish between hazards, greens and the like. However, it should also be clear that the present invention is not be considered as limited to the forms shown which are to be considered illustrative rather than restrictive.

I claim:

1. A method of adapting a golf course for playing golf at night using a glow in the dark golf ball comprising the steps of:

selecting an elongated flexible light source;

placing said elongated flexible light source along the perimeter of a golf course putting green;

selecting an earth anchor having a stake portion for driving into the earth and a flexible elongated light source holding end portion for attaching said elongated flexible lighting source thereto;

anchoring said placed elongated flexible light source to the earth with said selected earth anchor to provide a visible outline marking of the golf course putting green; and marking the golf course green golf hole with night visible markings;

whereby a golfer can play golf in the dark by driving a glow in the dark ball towards the inside of the perimeter lighted golf green and night visible golf green golf hole.

2. The method of adapting a golf course for playing golf at night accordance with claim 1 in which said marking of said golf course green golf hole includes marking with an illuminated flag pole.

3. The method of adapting a golf course for playing golf at night in accordance with claim 2 in which said marking of said golf course green golf hole includes marking the hole with said selected flexible perimeter light source.

4. The method of adapting a golf course for playing golf at night in accordance with claim 2 including placing said selected elongated flexible lighting source along the perimeter of a golf course hazard.

5. The method of adapting a golf course for playing golf at night in accordance with claim 1 including placing said selected elongated flexible lighting source along the perimeter of a golf course fairway.

6. The method of adapting a golf course for playing golf at night in accordance with claim 1 including the step of positioning said placed elongated flexible light source and earth anchor in the earth with a surface showing above the earth to form a surface for a golf ball to roll over.

7. The method of adapting a golf course for playing golf at night in accordance with claim 1 including selecting an earth anchor having a stake portion having a generally pointed end and a plurality of barbs thereon.

8. The method of adapting a golf course for playing golf at night in accordance with claim 1 including selecting an electro-luminescent elongated flexible light source.

9. The method of adapting a golf course for playing golf at night in accordance with claim 1 including selecting an elongated flexible light source having a plurality of incandescent bulbs mounted in a flexible transparent polymer tube.

10. The method of adapting a golf course for playing golf at night in accordance with claim 1 including selecting a elongated flexible fiber optic light source.

11. The method of adapting a golf course for playing golf at night in accordance with claim 1 including selecting an elongated flexible light emitting diode rope light source.

12. The method of adapting a golf course for playing golf at night in accordance with claim 5 including placing said selected elongated flexible lighting source along the perimeter of a golf course tee box.

13. The method of adapting a golf course for playing golf at night in accordance with claim 5 including placing said selected elongated flexible lighting source along the perimeter of golf course bunkers.

14. The method of adapting a golf course for playing golf at night in accordance with claim 5 including placing said selected elongated flexible lighting source along the perimeter of golf course trees.

15. The method of adapting a golf course for playing golf at night in accordance with claim 4 in which said elongated flexible lighting source along the perimeter of said golf course puffing green is one color and said elongated flexible lighting source along said perimeter of said golf course hazard is a second color.

* * * * *